United States Patent [19]

Lindell

[11] 4,190,374

[45] Feb. 26, 1980

[54] LOOSE-LEAF BINDER

[76] Inventor: Stig E. V. Lindell, Sagagatan 13, S-171 47 Solna, Sweden

[21] Appl. No.: 969,795

[22] Filed: Dec. 15, 1978

Related U.S. Application Data

[63] Continuation of Ser. No. 765,590, Feb. 4, 1977, abandoned.

[30] Foreign Application Priority Data

Feb. 23, 1976 [SE] Sweden ..... 7602082

[51] Int. Cl.[2] ..... B42F 3/00

[52] U.S. Cl. ..... 402/3; 402/43

[58] Field of Search ..... 402/3, 42, 44, 76; 281/31, 32; 40/359; 248/447; 312/233

[56] References Cited

U.S. PATENT DOCUMENTS

| | | | |
|---|---|---|---|
| 1,431,714 | 10/1922 | Wilking | 281/32 X |
| 1,598,206 | 8/1926 | Lindstept et al. | 402/3 |
| 2,907,332 | 10/1959 | Rankin | 402/76 X |
| 3,066,680 | 12/1962 | Duncan | 402/3 |
| 3,111,949 | 11/1963 | Duncan et al. | 402/3 |
| 3,205,894 | 9/1965 | Rankin | 402/42 X |
| 3,233,611 | 2/1966 | Stewart et al. | 402/42 |
| 3,544,230 | 5/1968 | Ohlsson | 402/3 |
| 3,807,883 | 4/1974 | Karlsson | 402/3 |
| 3,814,527 | 6/1974 | Lawes | 402/3 |
| 3,980,360 | 9/1976 | Wright et al. | 402/4 |

FOREIGN PATENT DOCUMENTS

| | | | |
|---|---|---|---|
| 1203315 | 7/1959 | France | 248/447 |

*Primary Examiner*—Robert L. Spicer, Jr.
*Attorney, Agent, or Firm*—Gipple & Hale

[57] ABSTRACT

A binder for hole-punched papers having a pair of covers and a spine, the outer side edges of which are connected to one of the covers, the spine being divided into a pair of longitudinally extending half-sections, having adjacent longitudinally extending inner edges. One of the half-sections has at least one rigid member extending transversely across substantially the entire width of the spine, to form a label holder and the other half section is provided with a recess for accommodating the rigid member in relationship in the closed position of the covers, the rigid member being accessible for insertion and removal of a label in the open position of the covers.

7 Claims, 6 Drawing Figures

LOOSE-LEAF BINDER

This is a continuation of application Ser. No. 765,590, filed Feb. 4, 1977, now abandoned.

The present invention relates to a loose leaf binder or file for collecting papers, hereinafter referred to as a binder. The spine of this binder is divided along its length into two spine halves mutually united by a hinge, there being label holders formed at the outer face of the spine halves and also grips for gripping the binder reliably with two fingers.

It is previously known to place a label holder on either spine half in binders with mutually hinged spine halves, the holders being so narrow that words on the labels must be syllabified to the detriment of easy reading. It has therefore also been proposed to let the label holder extend right across both spine halves, whereat the holder has consisted of a flexible bottom leaf with a transparent covering leaf, the two being joined along the bottom and vertical edges to retain a label between them. The drawback with this is that each time the binder is opened and closed, the holder and label are subjected to bending so that damage therefrom quickly arises. In addition, it is known to arrange finger grips in the spine halves or the spine, in the shape of holes open to the filed papers or the like, so that said papers or the like are inadequately protected there.

The present invention has the object of providing a binder with one or more label holders which, while they (it) extend(s) right across both spinehalves, avoid(s) being subjected to bending stresses during opening and closing of the binder, while finger grips arranged in the spinehalves are partitioned off from the papers or the like in the binder.

This object is achieved for a binder having a spine divided lengthwise into two halves united by a hinge and equipped with label holders right across substantially the whole of the spine of the binder, grips for fingers and holders for hole-punched papers and the like, and a locking device for locking together the spinehalves, all according to the invention and being distinguished in that one spine half is provided with at lest one plate-like rigid label holder firmly attached to this half, the other half being provided with a recess to accommodate the holder extending mainly over the whole of the binder spine.

The invention is illustrated by an embodiment shown as an example on the appended drawing where FIG. 1 shows a binder according to the invention, as seen from the outside, essentially parallel to the covers.

The binder according to the invention is of the type having the spine divided longitudinally in two halves 1 and 2 to which the covers 3 and 4 are hingedly attached. The spine halves 1 and 2 are mutually connected by hinge 5, formed in this case by the halves being covered with a layer of fabric 6, but can consist of plastic film forming, by means of a longitudinal channel, a so-called "plastic hinge". Conventional butt hinges could also be used instead between the spine halves, particularly if these are of sheet metal.

Figure 1:
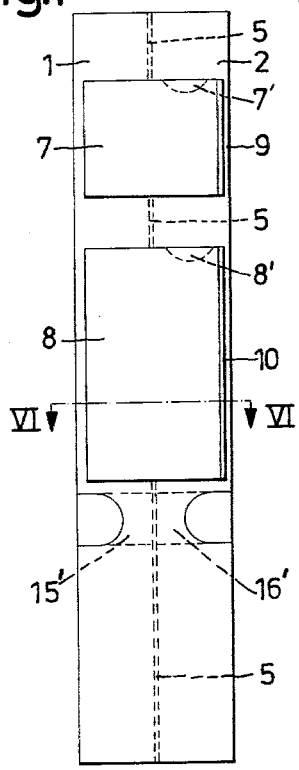
Figure 3:
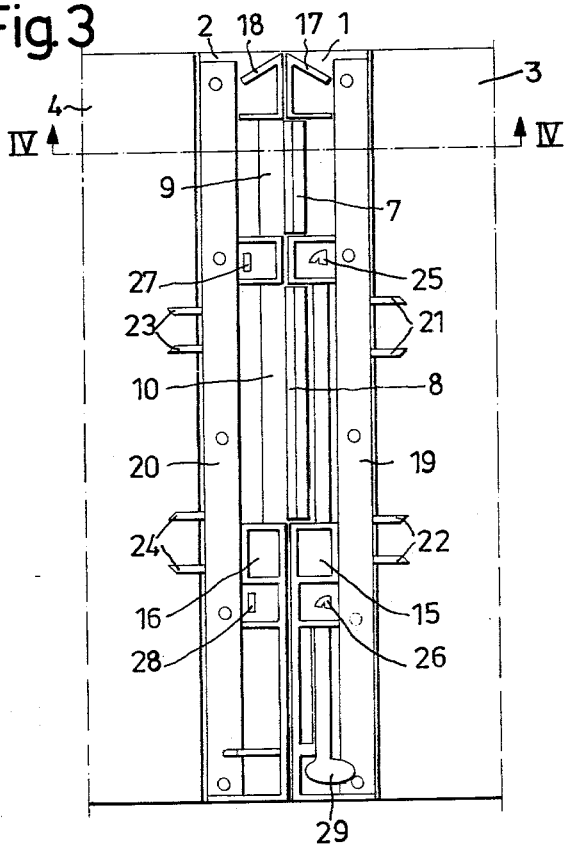
FIG. 3 shows the binder of FIG. 1 from the inside, with the covers completely open.
Figure 2:
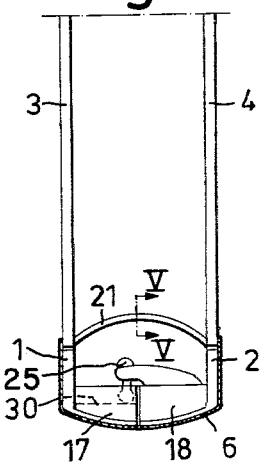
FIG. 2 shows the binder seen from above when in the normal upright storing position.
Figure 4:
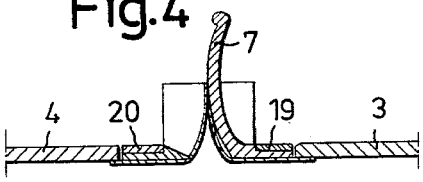
FIG. 4 shows a section along the line IV—IV in FIG. 3.
Figure 6:
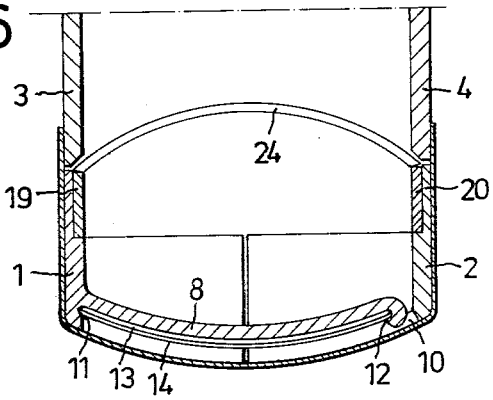
FIG. 6 shows, similarly to an enlarged scale, a section along line VI—VI in FIG. 1.

One spine half 1 carries two label holders 7, 8 firmly attached to it and substantially in the shape of a plate-like stiff flap, see FIG. 6. The holders each extend into a recess 9, 10 in the spine half 2, so that they extend mainly over the entire spine. The holders 7, 8 have at opposing vertical edges a turned-over edge 11 and 12, respectively, see FIG. 6, for positively retaining a label 13 with a transparent covering leaf 14, e.g. from plastic. The labels thus lie well protected between respective rigid label holder 7, 8 and covering leaf 14. The labels are meanwhile easily replaceable after opening the binder since the holders 7, 8 have an edge recess 7', 8' in their upper edges, allowing finger space for when the label 13 and covering leaf 14 are gripped for withdrawing from the folds 11, 12. Furthermore, the holders 7, 8 which are curved to follow the curved contour of the spine, are somewhat recessed in the spine halves, so that the covering leaf 14 is within the outer contour of the spine halves, as shown in FIG. 6. When the binder is opened, the holders 7, 8 accompany the movement of the spine half 1 and when the binder is swung completely open, the holders assume a position such as is shown in FIGS. 3 and 4. It will be appreciated that the holders and their contents are not subjected to any bending stresses during the process of opening or closing the binder.

In each spine half 1, 2, suitably below the holders, there is arranged a tunnel 15 and 16, respectively, with cutouts 15', 16' at the openings, so that a finger grip is formed, e.g. to facilitate removal of the binder from a row of such on a shelf, particularly if there is no room for gripping the upper edge of the spine. The tunnel allows the swinging suspension of the binder on a rod or the like, with the tunnel walls preventing the rod from coming into contact with, and possibly damaging the contents of the holder. The tunnels are interiorly smooth and easy on the fingers.

The upper part of each spine half 1, 2 has an inwardly—downwardly directed gripping flange member 17 and 18, under which a pair of fingers can be inserted when removing the binder from a shelf, swinging up a binder when it is carried on a rod or when carrying one or more binders in one hand.

Figure 5:
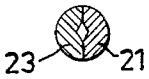
FIG. 5 shows a section along line V—V in FIG. 2, to an enlarged scale.

Strips 19, 20, preferably constructed of steel, are attached to spine halves 1, 2 respectively, to carry a pair of curved prongs 21, 22; 23, 24, each for holed sheets. The prongs 21–24 are attached to the outer edge of the respective strip 19, 20, i.e. the edge which is furthest from the hinge so that the forks can accommodate more papers or the like than when the prongs are attached to the upper face of the respective strip in the conventional manner. Furthermore, the prongs 21–24 are of a length such that when the binder is closed, they extend substantially along each other's whole length and each have a substantially semicircular cross-section as shown in FIG. 5, and mate together to form together part of the length of a ring. As is clear from FIG. 3, the prongs 21–24 are so shaped that on closing the binder, prongs 21 on the strip 19 go outside the prongs 23 on the strip 20, and prongs 22 on strip 19 go inside prongs 24 on strip 20 in mutual sliding engagement, whereby both strips 19, 20 and their prongs are made identically the same, only one type needing to be made, which can be turned round to suit the respective spine half. Since the prongs engage against each other along their entire length, they also form supports and guidance for each other and for the spine halves.

The latching device for the binder may be of a known kind, but according to FIG. 3 consists suitably of a pair of 2-step latches 25, 26, adapted to engage with locking hooks 27, 28 in the other spine half, and an operating lever 29, depressable parallel to the plane of the spine along a guiding edge 30. The lever is mounted in the binder so that an individual thumb has plenty of room to act on the lever 29 without the risk of being injured by sharp-edged papers, such as is the case when the lever is conventionally depressed normally to the plane of the spine.

The invention is not to be considered limited only to the embodiment described and shown on the drawing, but can be modified within the scope of the invention. For example, there may be one or more label holders, and in the latter case some can be attached to one spine half, while the rest are attached to the other spine half, the spine grip then being arranged halfway up the spine, for example.

I claim:

1. A binder comprising, in combination, a pair of covers, a spine interconnecting said covers for pivotal movement of said covers between an open and a closed position, said spine including a pair of spaced apart longitudinally extending half-sections having outer side edges connected to said covers, said half-sections being connected by a flexible member secured to said half sections defining a hinge, one of said half-sections being provided with label holder means comprising at least one substantially rigid flap member secured thereto extending over a portion of the length of said one half-section with one end of said flap extending substantially traverse from a portion of said one half-section to provide a plate-like projection; means on said projection to positively retain a label, said other half-section defining a recess opening into which the projection can extend and be seated when the covers of the binder are closed precluding the label holder means from being subjected to bending stresses during the process of opening and closing the binder, a latching device for selectively holding said half-sections together in the closed position of said covers, gripping means provided on said binder allowing for the insertion of fingers in said binder and means on said half-sections for holding hole-punched papers and the like.

2. A binder in accordance with claim 1 wherein said one half-section is provided with a pair of said substantially rigid flap members disposed in longitudinally spaced-apart relationship and wherein said other half-section defines a pair of said recesses disposed in longitudinally spaced-apart relationship corresponding to the spacing of said pair of flap members for receiving and accommodating said flap members.

3. A binder in accordance with claim 1 wherein said flap projection is curved and is offset inwardly of the outer surface of said half-sections when said binder is closed.

4. A binder in accordance with claim 1 wherein said gripping means further includes an inwardly directed tubular member on each of said half-sections, said tubular members being arranged in transversely axially aligned relationship on said half-sections and having open outer ends extending through said hinge member to provide finger grips, said tubular members being disposed in axially aligned relationship in the closed position of said covers to permit the insertion of a rod or the like therethrough.

5. A binder in accordance with claim 1 wherein said gripping means further includes a downwardly depending flange member secured to the inner surface of each of said half-sections adjacent the upper end of said spine for engagement by fingers when pulling forward, pivoting, carrying or the like of the binder.

6. A binder as claimed in claim 1, there being attached to each spine half a strip carrying page holders in the shape of curved prongs intended for coaction, characterized in that the prongs start out from the edges of strips situated furthest from the hinge of the spine halves.

7. A binder as claimed in claim 6, characterized in that the prongs have sufficient length for coacting prongs to extend adjacent each other along substantially the whole of their length, in the closed position of the binder.

* * * * *